US011927025B2

(12) United States Patent
Choi

(10) Patent No.: US 11,927,025 B2
(45) Date of Patent: Mar. 12, 2024

(54) MULTI-FUNCTIONAL WOODEN POLE HAVING IMPROVED ERECTNESS DUE TO TENDON

(71) Applicant: HUIN CO., LTD., Jeollanam-do (KR)

(72) Inventor: Gyu Woong Choi, Gwangju (KR)

(73) Assignee: HUIN CO., LTD., Jeollanam-do (KR)

( * ) Notice: Subject to any disclaimer, the term of this patent is extended or adjusted under 35 U.S.C. 154(b) by 308 days.

(21) Appl. No.: 17/608,895

(22) PCT Filed: Nov. 19, 2020

(86) PCT No.: PCT/KR2020/016342
§ 371 (c)(1),
(2) Date: Nov. 4, 2021

(87) PCT Pub. No.: WO2021/101261
PCT Pub. Date: May 27, 2021

(65) Prior Publication Data

US 2022/0349203 A1 Nov. 3, 2022

(30) Foreign Application Priority Data

Nov. 21, 2019 (KR) ..... 10-2019-0150308

(51) Int. Cl.
*E04H 12/16* (2006.01)
*E04H 12/04* (2006.01)
*E04H 12/22* (2006.01)

(52) U.S. Cl.
CPC ..... *E04H 12/16* (2013.01); *E04H 12/04* (2013.01); *E04H 12/22* (2013.01)

(58) Field of Classification Search
CPC ..... E04C 5/08; E04H 12/04; E04H 12/16; E04H 12/22; E04H 12/2269; E04H 12/2276; E04H 12/2292
See application file for complete search history.

(56) References Cited

U.S. PATENT DOCUMENTS 552,268 A * 12/1895 Wood ..... E04B 1/22 52/223.5
2,601,910 A * 7/1952 Nichols ..... E04C 3/18 52/847

(Continued)

FOREIGN PATENT DOCUMENTS

DE 102012106321 A1 * 1/2014 ..... E04H 12/04
FR 2686107 A1 * 7/1993 ..... E04C 2/40

(Continued)

OTHER PUBLICATIONS

International Search Report for PCT/KR2020/016342 dated Mar. 5, 2021.

(Continued)

*Primary Examiner* — James M Ference
(74) *Attorney, Agent, or Firm* — The PL Law Group, PLLC

(57) ABSTRACT

A multi-functional wooden pole according to an embodiment of the present disclosure has improved erectness due to a tendon is proposed. The multi-functional wooden pole is capable of maintaining a stable erection state while easily responding to a wind load even when an object having a predetermined weight is installed on an upper side of the wooden pole in a longitudinal direction thereof.

4 Claims, 16 Drawing Sheets

(56) References Cited

U.S. PATENT DOCUMENTS

| | | | | | |
|---|---|---|---|---|---|
| 3,145,540 | A * | 8/1964 | Baittinger | E02D 5/523 | 405/250 |
| 3,251,162 | A * | 5/1966 | Strimple | E04C 3/18 | 52/223.8 |
| 4,033,080 | A * | 7/1977 | Fukushima | E04H 12/02 | 405/250 |
| 4,166,347 | A * | 9/1979 | Pohlman | E04G 21/12 | 52/301 |
| 4,275,537 | A * | 6/1981 | Pinson | E04C 3/292 | 52/642 |
| 4,615,163 | A * | 10/1986 | Curtis | E04C 5/07 | 52/847 |
| 5,175,968 | A * | 1/1993 | Saucke | E04C 3/18 | 52/223.8 |
| 5,671,572 | A * | 9/1997 | Siller-Franco | E04G 23/0218 | 52/223.13 |
| 10,294,687 | B2 * | 5/2019 | Brockman | E04H 12/085 | |
| 2012/0240498 | A1 * | 9/2012 | Hurlebaus | E01F 9/696 | 52/745.19 |
| 2013/0008096 | A1 * | 1/2013 | Griffiths | E01F 9/635 | 52/99 |
| 2019/0112829 | A1 * | 4/2019 | Manos | E04B 1/2604 | |

FOREIGN PATENT DOCUMENTS

| | | | | |
|---|---|---|---|---|
| JP | 3497121 | B2 | 2/2004 | |
| KR | 10-0768439 | B1 | 10/2007 | |
| KR | 10-1294696 | B1 | 8/2013 | |
| KR | 10-1471164 | B1 | 12/2014 | |
| KR | 10-1647957 | B1 | 8/2016 | |
| WO | WO-9314282 | A1 * | 7/1993 | E04C 2/40 |

OTHER PUBLICATIONS

Office action dated Jan. 16, 2020 from Korean Patent Office in a counterpart Korean Patent Application No. 10-2019-0150308 (all the cited references are listed in this IDS.) (English translation is also submitted herewith.).

* cited by examiner

MULTI-FUNCTIONAL WOODEN POLE HAVING IMPROVED ERECTNESS DUE TO TENDON

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2020/016342, filed Nov. 19, 2020, which claims priority to the benefit of Korean Patent Application No. 10-2019-0150308 filed in the Korean Intellectual Property Office on Nov. 21, 2019, the entire contents of which are incorporated herein by reference.

BACKGROUND

1. Technical Field

The present disclosure relates generally to a multi-functional wooden pole having improved erectness due to a tendon. More particularly, the present disclosure relates to a multi-functional wooden pole having improved erectness due to a tendon which is capable of maintaining a stable erection state while easily responding to a wind load even when an object having a predetermined weight is installed on an upper side of the wooden pole in a longitudinal direction thereof.

2. Background Art

Generally, after excavating the installation site of a pole for a power light, traffic light, or street light, a foundation form is formed, concrete is poured and cured to form a foundation, and then the foundation is covered with soil, and the pole is installed on the foundation through an anchor.

Since such a pole is required to maintain rigidity thereof for a long time even in a harsh environment, the pole is made of metal, mainly made of cast iron or stainless steel. A cast iron pole has an advantage in that the cast iron is easy to be formed and can have various designs and is inexpensive, but the cast iron pole has a disadvantage in that the cast iron pole has poor appearance due to rust caused by corrosion. Although stainless steel has the advantage of having a smooth surface, the stainless steel is expensive and has the disadvantage of giving a unique cold feeling of metal like cast iron. Additionally, the stainless steel is not friendly to nature, and thus is difficult to harmonize with the surrounding environment.

Accordingly, recently, due to interest in urban environments and for establishing harmony with the surrounding environment, a wooden pole is used, and an object such as a power light, traffic light, or street light is installed on the upper part of the pole. However, in the case of the wooden pole, there is a problem in that it is not possible to efficiently secure erectness of the wooden pole due to expansion, contraction, cracking, distortion, deformation such as bending, decay caused by moisture, and deterioration of the durability of a part coupled to the surface of a foundation due to moisture. Furthermore, processing a non-standardized wood into wood having a predetermined standard requires a lot of effort and cost, and causes a large amount of the wood to be lost, which lowers economic efficiency.

In order to compensate for such problems, recently, a pole using a lamination technology which produces a large wooden member by bonding small pieces of woods to each other has been developed. However, the laminated pole also has a problem in that a coupling portion of the wooden laminated pole to each of a base plate and a top light is widened or split and is loosened due to wear of the coupling portion caused by a long-term external force such as vibration or a wind load. Compared to solid wood, laminated wood has a lower defect rate, but once abrasion or splitting occurs at a joint of the laminated wood, it is difficult to repair and reuse the laminated wood, so the laminated wood has a problem in that the laminated wood is required to be replaced.

As a background technology of the present disclosure, "STREET LAMP POST OF WOODS" is disclosed in Korean Patent No. 10-0768439.

SUMMARY

The present disclosure has been made keeping in mind the above problems occurring in the prior art, and the present disclosure is intended to propose a multi-functional wooden pole having improved erectness due to a tendon which is provided with a tension tendon located inside a wooden laminated pole manufactured by laminating short wooden members and installed to receive a tensile force supplied by a base connection unit and an upper tension unit, thereby facilitating the erectness of the laminated pole by easily responding to vibration and a wind load even if an object having a predetermined weight is installed on the longitudinal upper side of the laminated pole, and improving the posture resilience of the laminated pole.

In order to accomplish the above objectives, the present disclosure provides a multi-functional wooden pole having improved erectness due to a tendon, the wooden pole including: a base connection unit 100 mounted to a mounting surface; a wooden laminated pole 200 mounted erectly to an upper portion of the base connection unit 100 and having an insert hole 210 formed inside the wooden laminated pole along a longitudinal direction thereof; an upper tension unit 400 installed to be seated and fixed on a longitudinal upper side of the laminated pole 200; a tension tendon 500 located inside the insert hole 210 of the laminated pole 200 and having longitudinal opposite sides connected to the base connection unit 100 and the upper tension unit 400, respectively, such that the tension tendon 500 is fixedly mounted thereto while receiving a tensile force; and an object 600 installed on the longitudinal upper side of the laminated pole 200, wherein the base connection unit 100 is comprised of a flat base plate 110 installed to be seated on the mounting surface so as to support the wooden laminated pole 200, and a lower tension part 140 inserted into the insert hole 210 of the laminated pole 200 from an upper surface of the base plate 110 so as to tension and fix a longitudinal lower end of the tension tendon 500, wherein the lower tension part 140 is comprised of a hollow header 150 mounted fixedly to the base plate 110 and inserted into the insert hole 210, the hollow header 150 being configured to have an inner diameter decreasing gradually toward a longitudinal second side thereof from a longitudinal first side thereof, and a tension body 160 installed at an inside of the header 150 and configured to tension and fix the tension tendon 500 passing through the inside of the header 150 while pressing an outer circumferential surface of a first side of the tension tendon 500, the upper tension unit 400 is comprised of a flat mounting plate 410 installed to be seated on the longitudinal upper side of the laminated pole 200, and a tension connector 420 inserted into the insert hole 210 of the laminated pole 200 from a lower surface of the mounting plate 410 and configured to tension and fix a second side of the tension tendon 500, and the object 600 is installed to be connected to an upper surface of the mounting plate 410 of the upper tension unit 400.

In addition, the tension connector 420 may be mounted rotatably to the mounting plate 410 such that a longitudinal side of the tension connector 420 is held by a side surface of the mounting plate 410.

Furthermore, a holding through hole 413 may be formed in the mounting plate 410 such that the tension connector 420 passes through the holding through hole 413, and a slope holding end 414 may be formed on an edge of the holding through hole 413 such that the slope holding end 414 is inclined downward in an inward direction, and the tension connector 420 may be comprised of a hollow insert header 421 having a rotation seating end 422 formed at a longitudinal side thereof such that the rotation seating end 422 is held by the slope holding end 414, and a tendon fixer 423 installed to be inserted into the insert header 421 and configured to tension and fix the tension tendon 500 while pressing an outer circumferential surface of the tension tendon 500.

Additionally, the tension tendon 500 may be configured to have a twisted structure in which multiple strands are spirally twisted to each other relative to an axial line.

According to the present disclosure, on the basis of the strong tensile and fixing forces of the tension tendon located inside the laminated pole having a predetermined length and tensioned and fixed by the base connection unit and the upper tension unit, the multi-functional wooden pole can improve erectness by easily responding to a wind load even when an object having a predetermined weight such as a sculpture or a lighting device is installed at the upper portion of the laminated pole.

DETAILED DESCRIPTION

Figure 1:
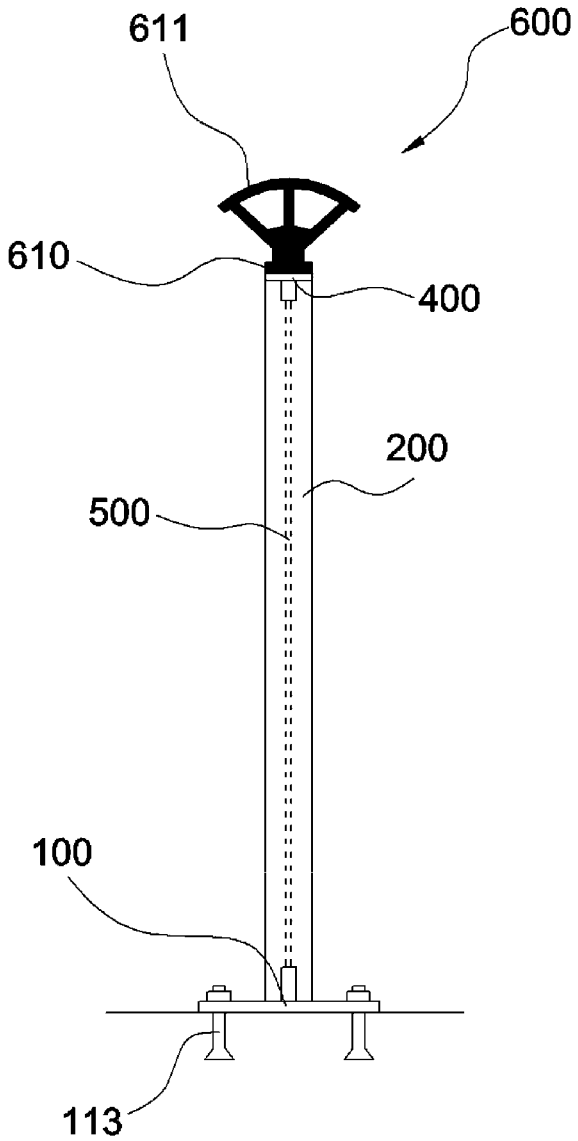
FIG. 1 is a view illustrating the state of a multi-functional wooden pole having improved erectness due to a tendon according to an embodiment of the present disclosure.

In the description of the present invention, when it is determined that a detailed description of a related known function or configuration may unnecessarily obscure the gist of the present disclosure, the detailed description thereof will be omitted.

In addition, terms described below are terms set in consideration of the functions of the components in the present disclosure, and these terms may vary according to the intention or custom of a manufacturer producing a product, and the thickness of lines or the size of components, etc. illustrated in the drawings may be exaggerated for clarity and convenience of explanation. The embodiments described in this specification and configurations illustrated in the drawings are only the exemplary embodiments of the present disclosure and do not represent all the technical spirit of the present disclosure, so it should be understood that there may be various equivalents and modified embodiments that may be substituted at the time of the present application.

Furthermore, throughout the present specification, when a part is "connected" with another part, this includes not only a case in which they are "directly connected" with each other, but also a case in which they are "indirectly connected" with each other with another component placed therebetween. In addition, "including" a certain component means that other components may be further included rather than excluding other components, unless otherwise stated.

In addition, directional terms used in the present disclosure are used in relation to the directions of the accompanying drawings. According to the embodiments of the present disclosure, components may be set to be positioned in various directions, so the directional terms is used for illustrative purposes, but are not limited to the embodiments.

Figure 2:
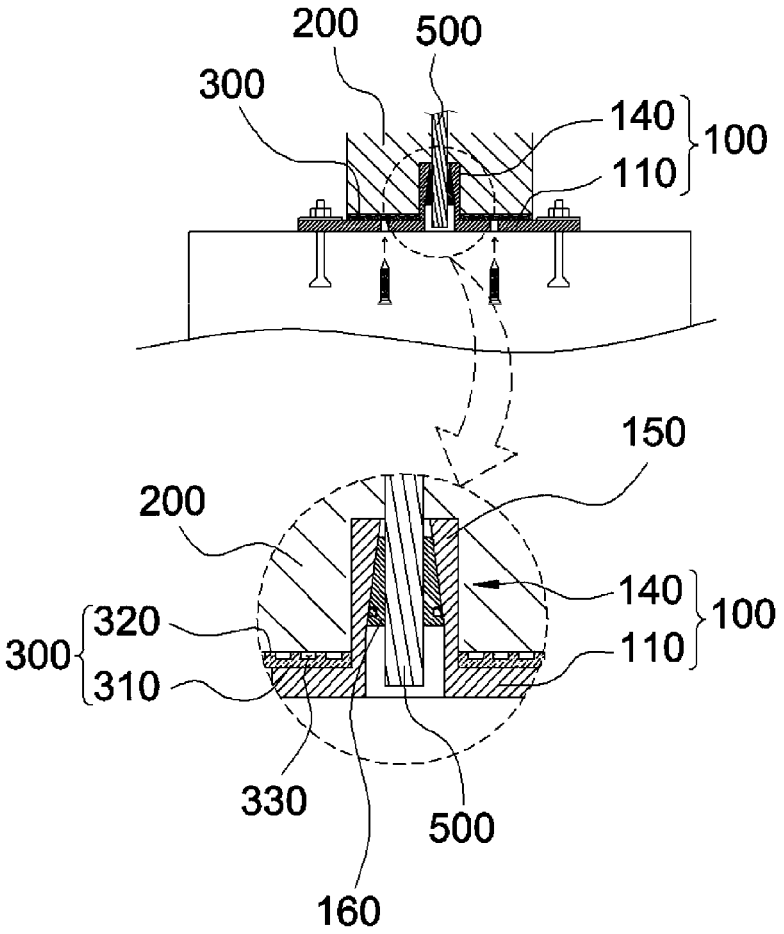
FIG. 2 is a sectional view illustrating the state of the section of a base connection unit according to the embodiment of the present disclosure.
Figure 3:
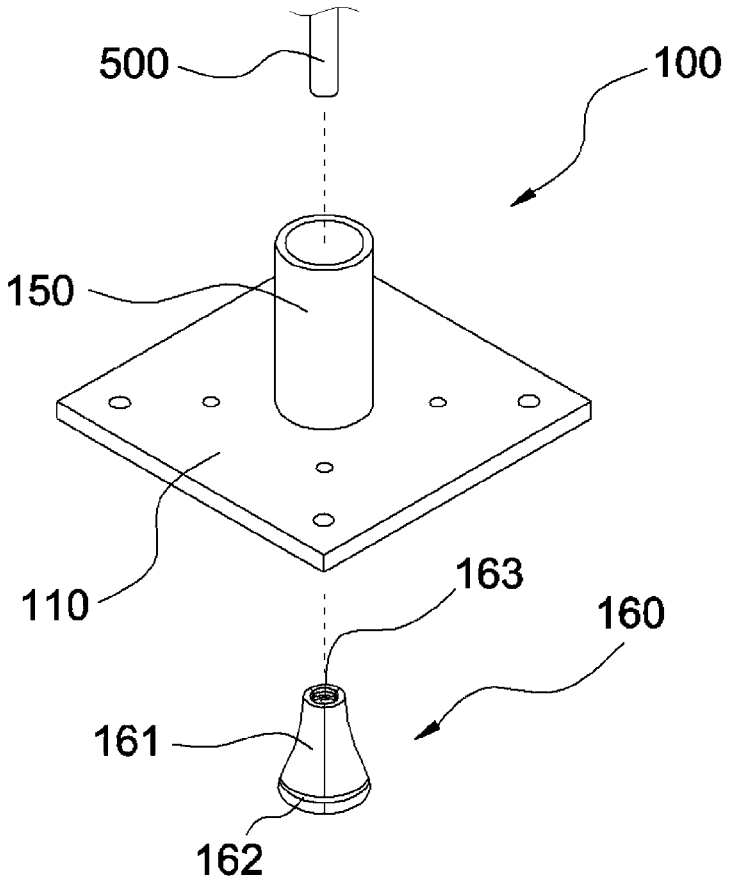
FIG. 3 is an exploded perspective view illustrating the separated state of the components of the base connection unit according to the embodiment of the present disclosure.
Figure 4:
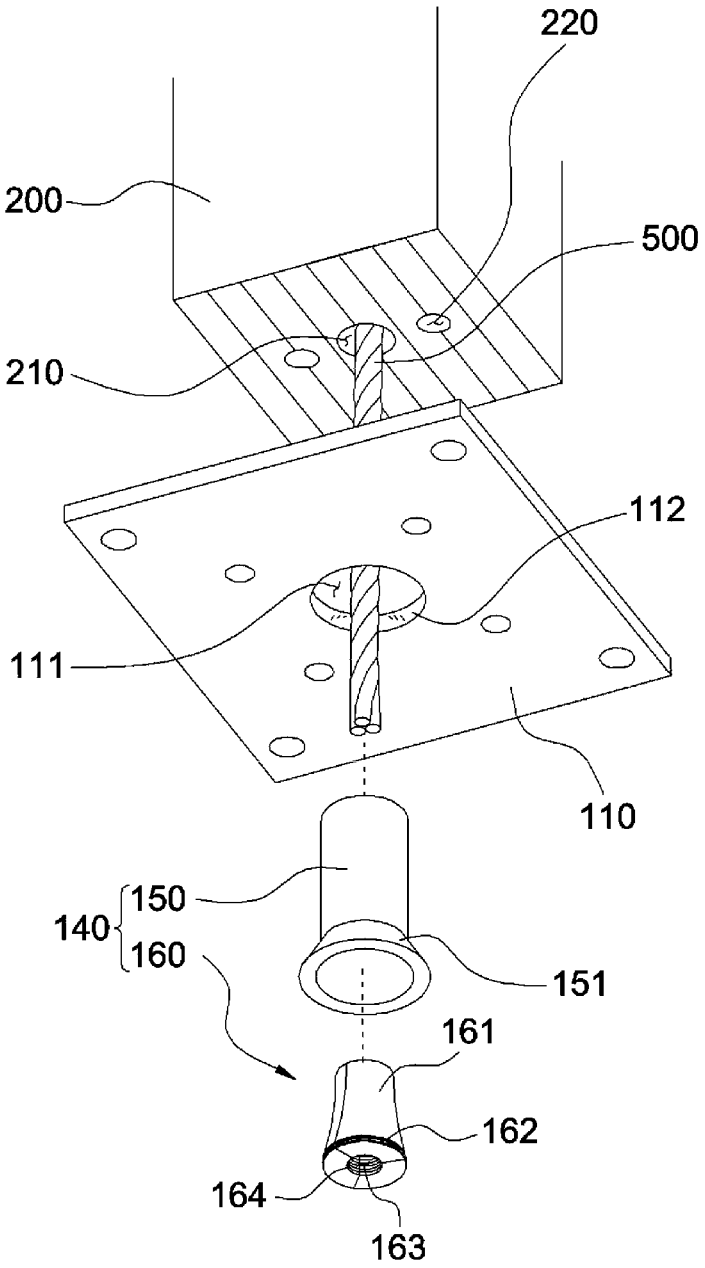
FIG. 4 is an exploded perspective view illustrating the separated state of the components of the base connection unit according to another embodiment of the present disclosure.
Figure 5:
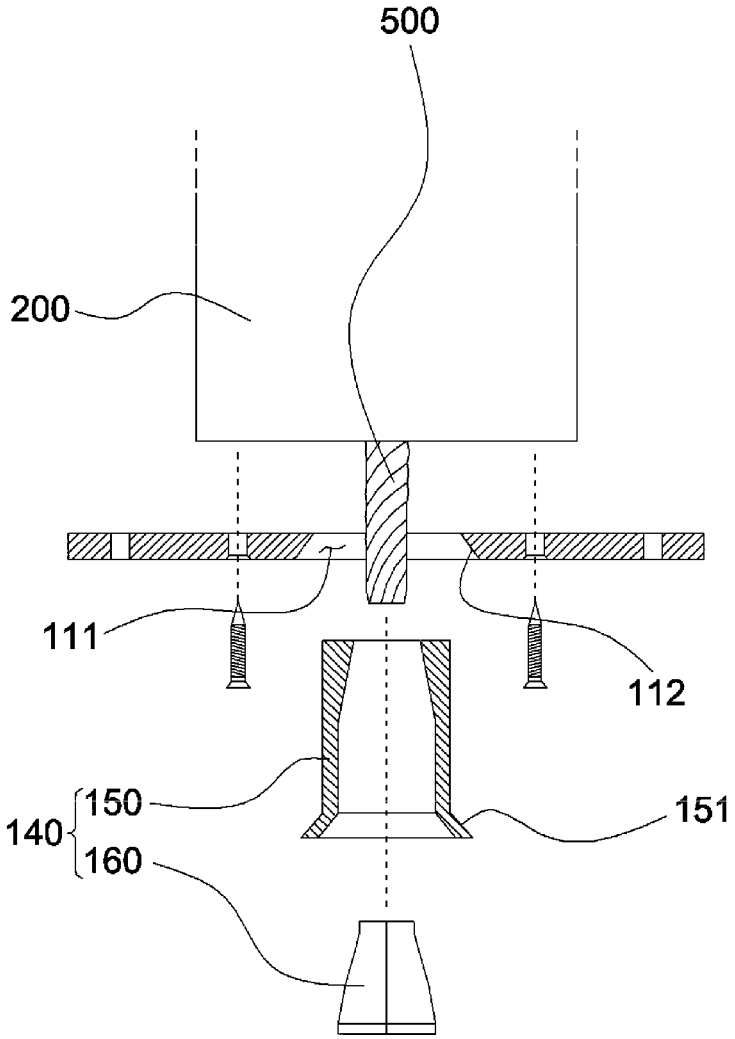
FIG. 5 is a sectional view illustrating the sectional state of the base connection unit according to the another embodiment of the present disclosure.
Figure 6:
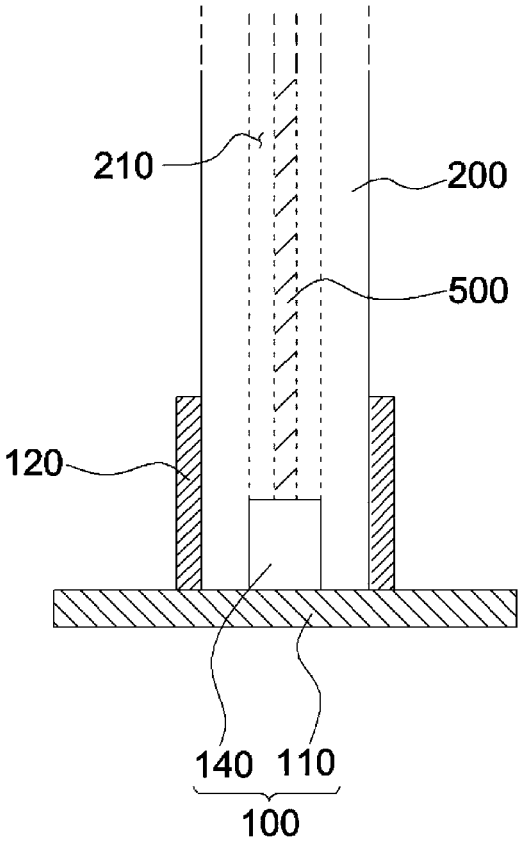
FIG. 6 is a view illustrating a state in which a lower reinforcement is mounted to the base connection unit according to the embodiment of the present disclosure.
Figure 7:
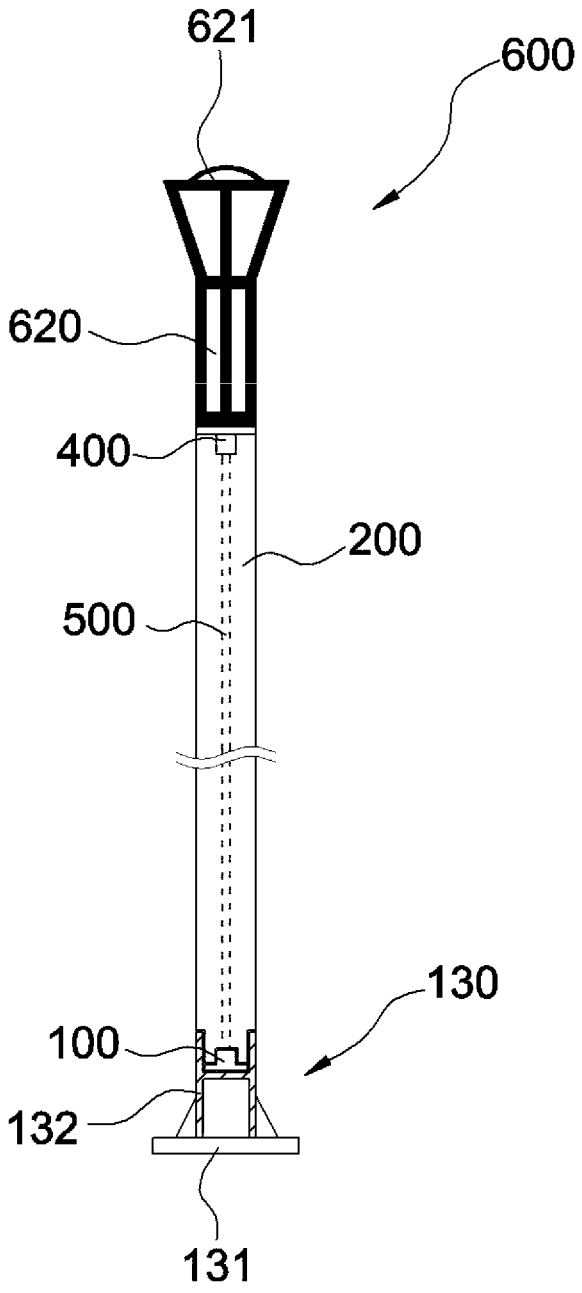
FIG. 7 is a view illustrating a state in which a lower body part is provided at a lower side of a laminated pole according to the present disclosure.
Figure 8:
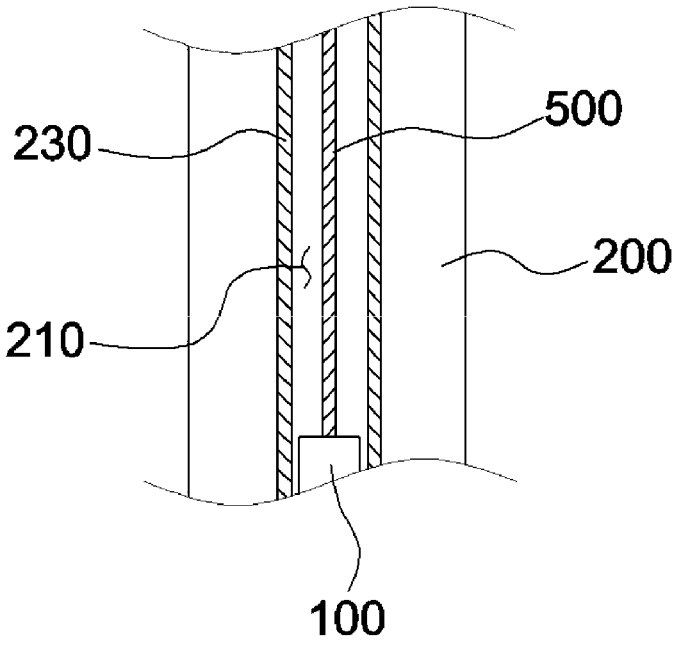
FIG. 8 is a view illustrating a state in which a core is installed inside the laminated pole according to the present disclosure.
Figure 9:
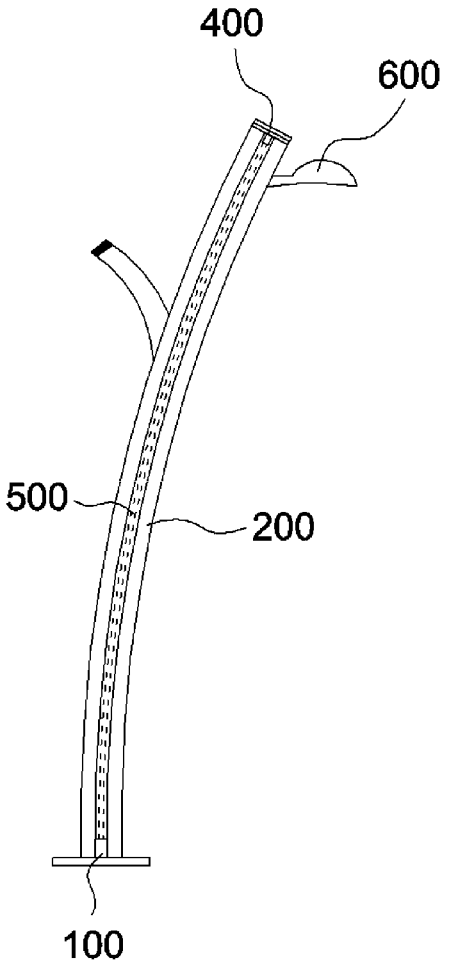
FIG. 9 is a view illustrating a state in which the laminated pole according to the present disclosure is formed to be curved.
Figure 10:
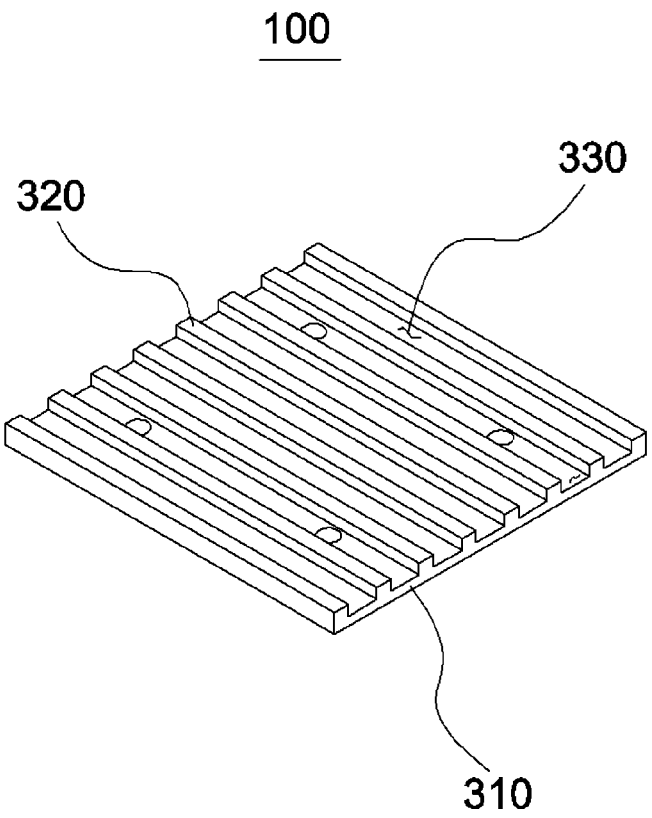
FIG. 10 is a view illustrating the state of a ventilation unit according to the present disclosure.
Figure 11:
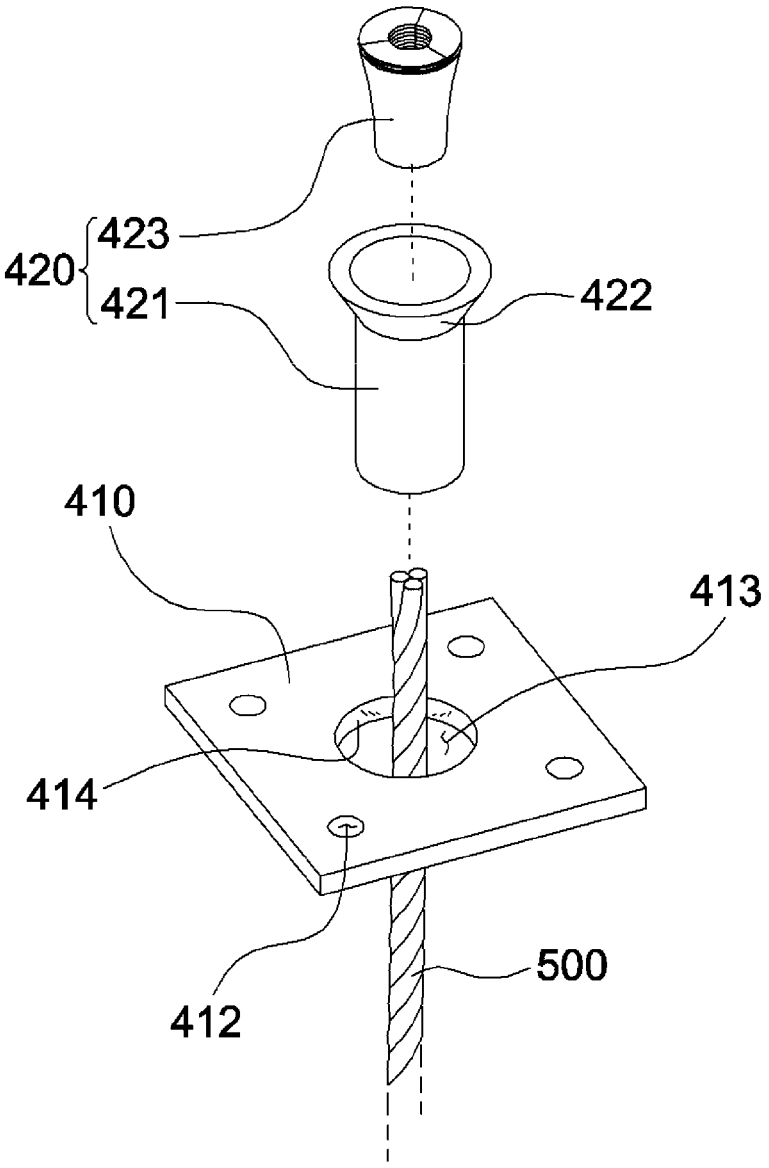
FIG. 11 is an exploded perspective view illustrating an upper tension unit according to the embodiment of the present disclosure.
Figure 12:
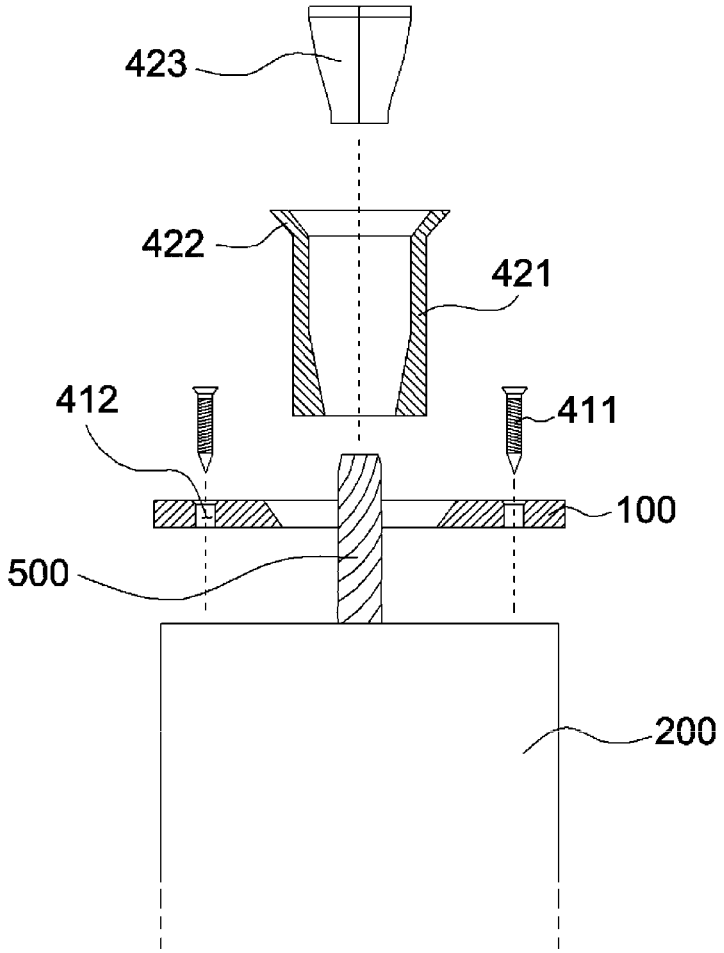
FIG. 12 is a sectional view illustrating the sectional state of the upper tension unit according to the embodiment of the present disclosure.
Figure 13:
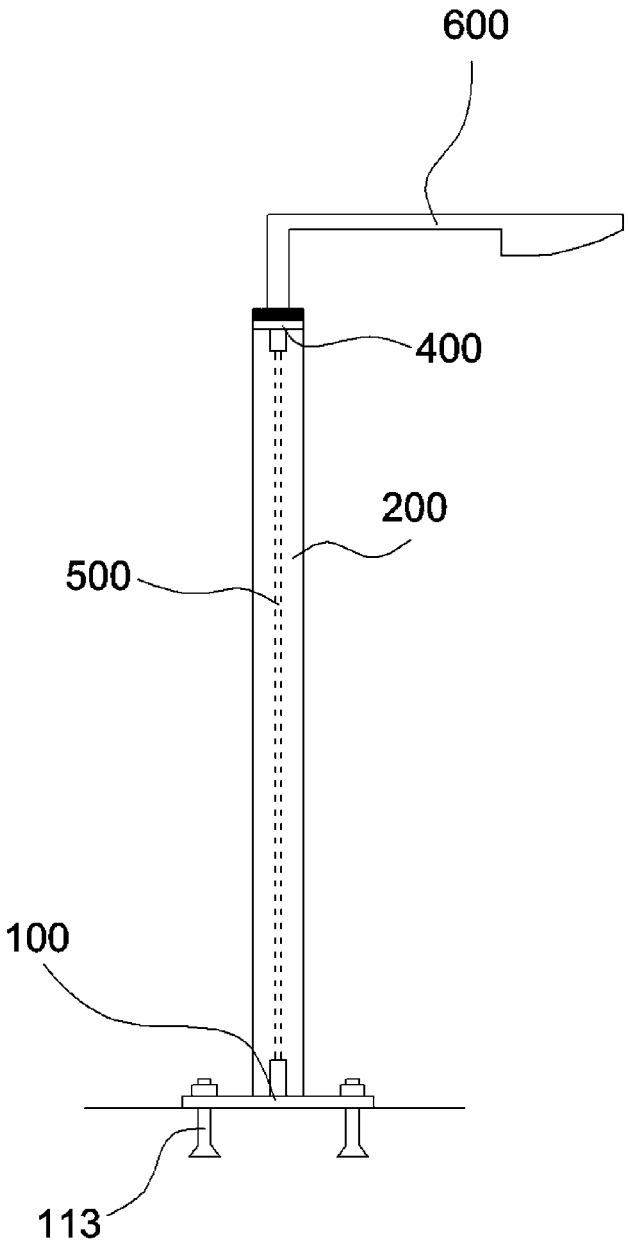
FIG. 13 is a view illustrating an example of the state of an object installed at the upper side of the laminated pole according to the present disclosure.
Figure 14:
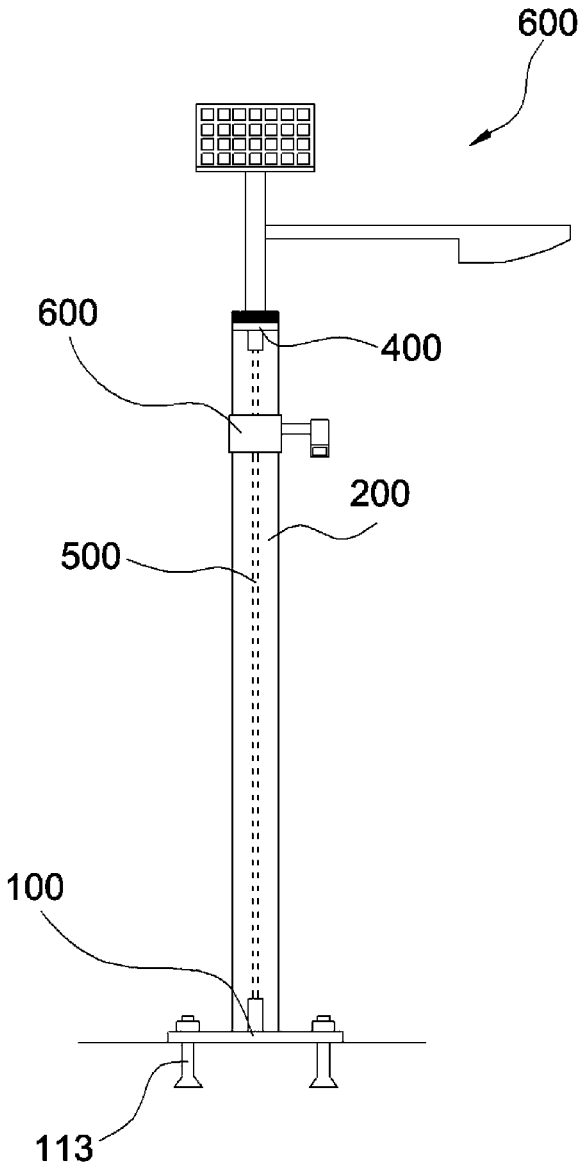
FIG. 14 is a view illustrating another example of the state of an object installed at the upper side of the laminated pole according to the present disclosure.
Figure 15:
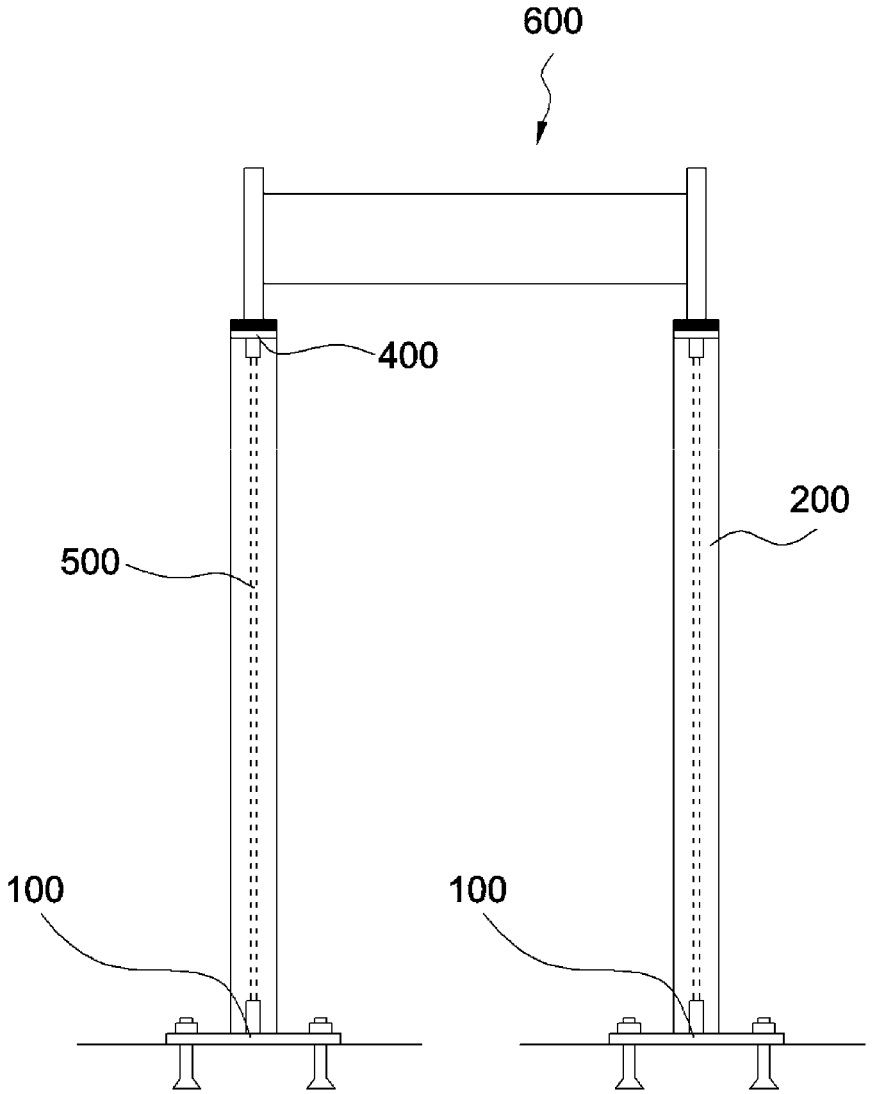
FIG. 15 is a view illustrating an example of the state of a structure in which the object is installed by using a pair of laminated poles according to the present disclosure.
Figure 16:
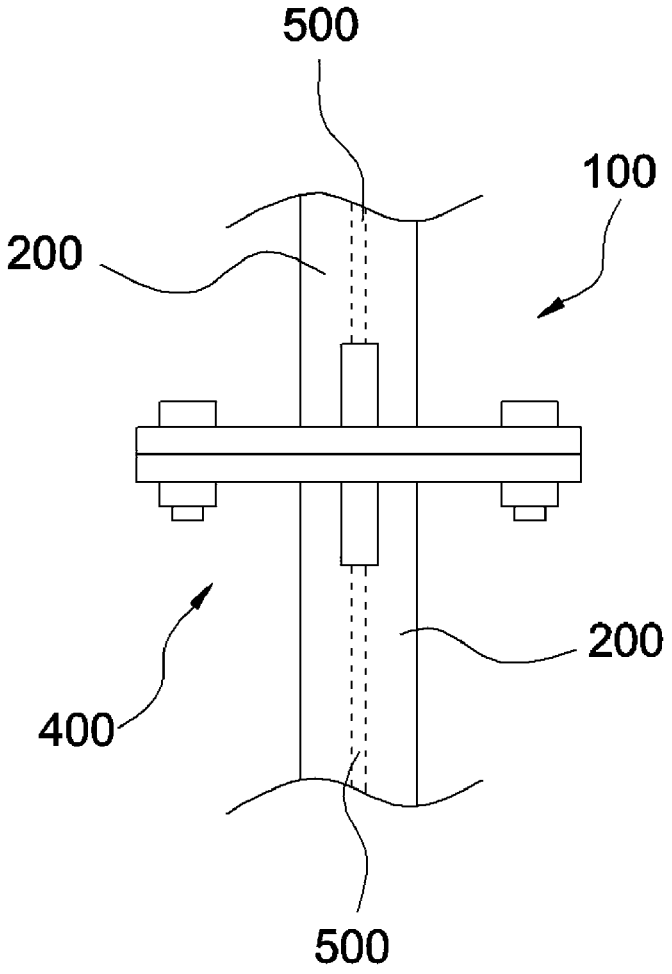
FIG. 16 is a view illustrating the state of the erect installation of the wooden pole according to still another embodiment of the present disclosure.

FIG. 1 is a view illustrating the state of a multi-functional wooden pole having improved erectness due to a tendon according to an embodiment of the present disclosure; FIG. 2 is a sectional view illustrating the state of the section of a base connection unit according to the embodiment of the present disclosure; FIG. 3 is an exploded perspective view illustrating the separated state of the components of the base connection unit according to the embodiment of the present disclosure; FIG. 4 is an exploded perspective view illustrating the separated state of the components of the base connection unit according to another embodiment of the present disclosure; FIG. 5 is a sectional view illustrating the sectional state of the base connection unit according to the another embodiment of the present disclosure; FIG. 6 is a view illustrating a state in which a lower reinforcement is mounted to the base connection unit according to the embodiment of the present disclosure; FIG. 7 is a view illustrating a state in which a lower body part is provided at a lower side of a laminated pole according to the present disclosure; FIG. 8 is a view illustrating a state in which a core is installed inside the laminated pole according to the present disclosure; FIG. 9 is a view illustrating a state in which the laminated pole according to the present disclosure is formed to be curved; FIG. 10 is a view illustrating the state of a ventilation unit according to the present disclosure; FIG. 11 is an exploded perspective view illustrating an upper tension unit according to the embodiment of the present disclosure; FIG. 12 is a sectional view illustrating the sectional state of the upper tension unit according to the embodiment of the present disclosure; FIG. 13 is a view illustrating an example of the state of an object installed at the upper side of the laminated pole according to the present disclosure; FIG. 14 is a view illustrating another example of the state of an object installed at the upper side of the laminated pole according to the present disclosure; FIG. 15 is a view illustrating an example of the state of a structure in which the object is installed by using a pair of laminated poles according to the present disclosure; and FIG. 16 is a view illustrating the state of the erect installation of the wooden pole according to still another embodiment of the present disclosure.

As illustrated in FIGS. 1 to 16, the multi-functional wooden pole having improved erectness due to a tendon according to the present disclosure includes: the base connection unit 100 mounted to a mounting surface; the wooden laminated pole 200 mounted erectly to the upper portion of the base connection unit 100 and having an insert hole 210 formed inside the wooden laminated pole 200 along a longitudinal direction thereof; the upper tension unit 400 installed to be seated on the upper side of the laminated pole 200; a tension tendon 500 installed inside the laminated pole 200 and tensioned and fixed by being connected to the base connection unit 100 and the upper tension unit 400 therebetween; and an object 600 mounted to the upper portion of the laminated pole 200.

That is, according to the multi-functional wooden pole having improved erectness due to a tendon according to the present disclosure, the wooden laminated pole 200 is mounted erectly on the upper portion of the base connection unit 100, and then the force of supporting the laminated pole 200 is improved by the tension tendon 500 such that a firm wooden pole can be provided. In addition, even if an object having a predetermined weight, such as a sculpture, a lighting device, a speaker, a camera, a photovoltaic device, or a sign is installed on the longitudinal upper side of the laminated pole, the wooden laminated pole 200 can maintain a stable erect state, and can efficiently maintain erectness for a long period of time even if the laminated pole 200 has a curved shape or a long structure.

The base connection unit 100 is mounted to the mounting surface on which the multi-functional wooden pole according to the present disclosure is installed. More specifically, the base connection unit 100 may be fixedly mounted to the mounting surface, on which the wooden pole according to the present disclosure is installed, by anchor bolts 113 or welding.

Here, referring to the embodiment of the base connection unit 100, the base connection unit 100 may be comprised of a base plate 110 installed to be seated on the mounting surface so as to support the wooden laminated pole 200, and a lower tension part 140 inserted into the insert hole 210 of the laminated pole 200 from the upper surface of the base plate 110 so as to tension and fix the longitudinal lower end of the tension tendon 500 to be described later.

In this case, in a case in which a lower reinforcement 120 is installed on the base plate 110, while the longitudinal lower side of the laminated pole 200 is inserted in the lower reinforcement 120, the lower tension part 140 may be configured to be inserted into the insert hole 210 of the laminated pole 200.

In addition, referring to the lower tension part 140, the lower tension part 140 may be comprised of a hollow header 150 mounted fixedly to the base plate 110 and inserted into the insert hole 210, the hollow header 150 being configured to have an inner diameter decreasing gradually toward a longitudinal second side thereof from a longitudinal first side thereof, and a tension body 160 installed at the inside of the header 150 and configured to tension and fix the tension tendon 500 passing through the inside of the header 150 while pressing an outer circumferential surface of a first side of the tension tendon 500.

In this case, while the tension body 160 is inserted in the header 150, the tension body 160 presses and fixes the tension tendon 500 while tensioning the outer circumferential surface of the tension tendon 500 due to the inner circumferential surface of the header 150 which is gradually decreasing. The tension body 160 may be comprised of three split wedge pieces 161 having arc shapes in outer and inner surfaces, and an elastic ring 162 installed to cover the upper side of the split wedge pieces 161, wherein the split wedge pieces 161 are connected to each other by the elastic ring 162 and a tendon passing hole 163 is formed in the center portion of the split wedge pieces 161 connected to each other such that the tension tendon 500 passes through the tendon passing hole 163.

Here, a tendon pressing part 164 having a thread shape is formed on the inner circumferential surface of each of the split wedge pieces 161, the tendon pressing part being formed continuously from a longitudinal first side of the split wedge piece to a longitudinal second side thereof. Accordingly, when the tension body 160 is inserted into the header 150, the tendon pressing part 164 firmly holds the outside of the tension tendon 500.

In this case, the lower tension part 140 is described to be mounted fixedly to the base plate 110, but is not limited thereto. The lower tension part 140 may be mounted rotatably to the base plate 110 with a longitudinal side of the lower tension part 140 held in the base plate 110.

In this case, a fitting hole 111 is formed in the base plate 110 such that the longitudinal side of the lower tension part 140 can be held in the fitting hole 111 with the lower tension part 140 passing through the fitting hole. An inclined holding end 112 is formed in the fitting hole 111 such that the header 150 is rotatable while a longitudinal side of the header 150 is held by the inclined holding end 112, wherein the inclined holding end 112 is configured to be inclined upward in an inward direction from the edge of the fitting hole 111.

In this case, a rotation guide jaw 151 is formed on a longitudinal end of the header 150, the rotation guide jaw 151 being seated and held in the inclined holding end 112, wherein the rotation guide jaw 151 is formed by extending downward from the end portion of the header 150 and having an outer circumferential surface inclined outward such that the rotation guide jaw 151 corresponds to the inclined holding end 112. When the rotation guide jaw 151 is seated on the inclined holding end 112, the lower surface of the rotation guide jaw 151 and the lower surface of the base plate 110 are positioned on the same line such that the lower side of the rotation guide jaw 151 does not protrude to the outside of the base plate 110.

Meanwhile, the lower reinforcement 120 may be installed on the base plate 110 such that the longitudinal lower side of the wooden laminated pole 200 can be fitted and fixed to the lower reinforcement 120.

In addition, the lower body part 130 may be mounted to the mounting surface, the lower body part being configured to fix the longitudinal lower side of the wooden laminated pole 200. In this case, the base connection unit 100 may be configured to be installed inside the lower body part 130.

That is, the lower body part 130 is comprised of a flange 131 mounted to the mounting surface, and a tubular joint pipe 132 mounted erectly to the upper portion of the flange 131, and may be configured such that the wooden laminated pole 200 is inserted into the joint pipe 132 and the base connection unit 100 is seated on a side of the inserted wooden laminated pole 200.

In addition, the wooden laminated pole 200 is mounted erectly to the upper portion of the base connection unit 100 and has the insert hole 210 formed inside the wooden laminated pole 200 along a longitudinal direction thereof such that the insert hole is hollow. The wooden laminated pole 200 may be manufactured by drilling the insert hole 210 in a wooden member having a predetermined length along a longitudinal direction thereof, but in this case, processing the insert hole 210 in a straight line may be considerably difficult. Accordingly, the insert hole 210 is manufactured by laminating multiple short wooden members to each other. Particularly, an arc-shaped hole is processed in each of short wooden members of a portion at which the insert hole 210 is formed, and the short wooden members are laminated to each other with the arc-shaped holes facing each other such that the insert hole 210 can be formed.

In this case, during the manufacturing of the laminated pole 200, together with the insert hole 210, a separate wire introduction hole 220 may be formed. Accordingly, when a lighting device as the object is installed on the longitudinal upper portion of the wooden pole according to the present disclosure, a power line for power supply may extend to the lighting device through the wire introduction hole 220, but is not limited thereto. In a case in which the wire introduction hole 220 is not formed, a power line may extend to the lighting device through the insert hole 210.

Furthermore, the core 230 may be installed in the insert hole 210 of the laminated pole 200 along a longitudinal direction thereof. This is intended to facilitate the manufacturing of a laminated pole having a predetermined length by laminating multiple short wooden members to each other and to facilitate the manufacturing of a laminated pole having a predetermined curvature to enhance the aesthetic element of the wooden pole according to the present disclosure.

Here, a ventilation unit 300 may be provided at the longitudinal lower end of the laminated pole 200 such that at a position between the base connection unit 100 and the laminated pole 200, ventilation is secured or the flow of rainwater to the outside is facilitated.

Referring to the embodiment of the ventilation unit 300, the ventilation unit 300 may be comprised of a base piece 310 installed to be seated on the upper surface of the base plate 110, and multiple spacers 320 formed on the upper surface of the base piece 310 by protruding therefrom with the multiple spacers being spaced apart at predetermined intervals from each other.

That is, in a state in which the ventilation unit 300 is seated on the upper surface of the base plate 110, when the laminated pole 200 is installed erectly, a ventilating hole 330 is formed at a side of the end portion of the laminated pole 200 due to the spacers 320 of the ventilation unit 300. Accordingly, in case of rain, rainwater flowing down along the outer surface of the laminated pole 200 does not stagnate at the bottom of the laminated pole 200, but flows to the outside through the ventilating hole 330, and further, due to the ventilating hole 330, the lower end of the laminated pole 200 is rapidly dried. Accordingly, the lower end of the laminated pole 200 can be prevented from being decayed, and a tensile force of the tension tendon 500 can be prevented from losing due to the decaying of the lower end of the laminated pole 200.

Here, the ventilation unit 300 is described to include the base piece 310 and the spacers 320, but is not limited thereto. The multi-functional wooden pole of the present disclosure may have various structures including a structure in which multiple spacers are formed on the upper surface of the base plate 110 such that during the mounting of the laminated pole 200 to the base plate 110, ventilating holes are formed between the end portion of the laminated pole 200 and the upper surface of the base plate 110, or a structure in which multiple through-holes are formed in the base plate 110 such that rainwater moving downward along the side surface of the laminated pole 200 can be rapidly discharged to the outside of the base plate 110 through the through-holes.

The upper tension unit 400 is installed to be seated and fixed on the longitudinal upper side of the laminated pole 200. As for the upper tension unit 400 according to the embodiment, the upper tension unit 400 may be comprised of the mounting plate 410 installed to be seated on the longitudinal upper side of the laminated pole 200, and a tension connector 420 which is inserted into the insert hole 210 of the laminated pole 200 mounted to the mounting plate 410 and tensions and fixes a second side of the tension tendon 500.

In this case, a bolt inserting hole 412 is formed in the mounting plate 410 such that a fastening bolt 411 fastened to the longitudinal upper side of the laminated pole 200 passes through the bolt inserting hole, and the tension connector 420 is a part configured to tension and fix the second side of the tension tendon 500 to be described later, and is inserted into the insert hole 210 of the laminated pole 200 and is hidden, so an object having a predetermined weight, such as a sculpture, a lighting device, a photovoltaic device, or a speaker as an example of the object 600 to be described later can be easily installed at the longitudinal upper side of the laminated pole 200. Here, the tension connector 420 may be mounted fixedly or rotatably to the mounting plate 410.

When rotatably mounting the tension connector 420 to the mounting plate 410 such that a longitudinal side of the tension connector 420 is held by a side surface of the mounting plate 410, a holding through hole 413 is formed in the mounting plate 410 such that the tension connector 420 passes through the holding through hole, and a slope holding end 414 is formed on the edge of the holding through hole 413 such that the slope holding end 414 is inclined downward in an inward direction.

In addition, the tension connector 420 may be comprised of a hollow insert header 421 having a rotation seating end 422 formed at a longitudinal first side thereof such that the rotation seating end 422 is held by the slope holding end 414, and a tendon fixer 423 installed to be inserted into the insert header 421 and configured to tension and fix the tension tendon 500 while pressing the outer circumferential surface of the tension tendon 500.

That is, the insert header 421 is configured to have an inner diameter decreasing gradually toward a longitudinal second side thereof from the longitudinal first side thereof, and the rotation seating end 422 is formed by extending upward from the end portion of the insert header 421 and having an outer circumferential surface inclined outward such that the rotation seating end 422 corresponds to the slope holding end 414.

In this case, when the rotation seating end 422 is seated on the slope holding end 414, the upper surface of the rotation seating end 422 and the upper surface of the mounting plate 410 are positioned on the same line such that the upper side of the rotation seating end 422 does not protrude to the outside of the mounting plate 410.

Furthermore, the tendon fixer 423 is configured to have the same structure as the structure of the tension body 160, and is inserted into the insert header 421 and presses and fixes the tension tendon 500 while tensioning the outer circumferential surface of the tension tendon 500 due to the inner circumferential surface of the insert header 421 which is gradually decreasing.

In addition, the tension tendon 500 is located inside the insert hole 210 of the laminated pole 200, and the longitudinal opposite sides of the tension tendon 500 are connected to the base connection unit 100 and the upper tension unit 400, respectively, such that the tension tendon 500 is fixedly mounted thereto while receiving a tensile force.

That is, the tension tendon 500 is installed inside the laminated pole 200 along a vertical longitudinal direction thereof, and is fixedly installed while receiving a tensile force by the base connection unit 100 and the upper tension unit 400 mounted to the longitudinal opposite sides of the laminated pole 200, respectively. Accordingly, in a state in which the object 600 is installed on the upper portion of the laminated pole 200, the tension tendon 500 enables the laminated pole 200 to easily maintain erectness by easily responding to a wind load applied to the object 600.

That is, since the tension tendon 500 is installed while receiving a tensile force by the base connection unit 100 and the upper tension unit 400, the tension tendon 500 supplies the tensile force to the laminated pole 200, and thus the restoring force of the laminated pole 200 against a wind load applied to the object 600 is improved, and the deformed amount of the laminated pole 200 is minimized, so the stable erectness of the laminated pole 200 can be maintained.

In this case, the tension tendon 500 may use a tendon made of one steel wire, but is not limited thereto. The tension tendon 500 may selectively use a tension tendon having a twisted structure in which multiple strands are spirally twisted to each other relative to one axial line, depending on the installation situation or environment of the wooden pole.

Accordingly, on the basis of the strong tensile and fixing forces of the tension tendon 500 tensioned and fixed by the base connection unit 100 and the upper tension unit 400, the wooden pole of the present disclosure can have improved erectness by easily responding to a wind load even if an object having a predetermined weight such as a sculpture or a lighting device is installed on the upper portion of the laminated pole 200.

Here, one or more tension tendons 500 may be installed inside the laminated pole 200 as required.

In addition, the object 600 is a structure installed on the longitudinal upper side of the laminated pole 200, and may be a structure having a predetermined weight such as a sculpture, a lighting device, a photovoltaic device, a speaker, or an information sign. Depending on a section in which the object 600 described above is installed as, the laminated pole 200 may be formed in various shapes such as rectilinear and curved shapes for harmony of the laminated pole with surrounding facilities and beauty of the laminated pole.

In this case, when installing the object 600 on the upper end of the laminated pole 200, the object 600 is installed to be connected to the mounting plate 410 of the upper tension unit 400 such that the tensile force of the tension tendon 500 can be transmitted between a fixed portion of the tension tendon 500 to the base connection unit 100 and a fixed portion of the tension tendon 500 to the upper tension unit 400.

Here, in a case in which the object 600 is a lighting device, according to an embodiment, the lighting device may be comprised of a mounting board 610 mounted to the mounting plate 410 of the upper tension unit 400, and a lighting part 611 located at the upper side of the mounting board 610 and receiving a luminous body emitting light by external power.

In the state in which the lighting device having a predetermined weight is installed on the upper portion of the laminated pole 200, when a wind load is applied to the object 600, the deformed amount of the laminated pole decreased since the restoring force of the laminated pole 200 against the wind load is improved due to the tension tendon 500 installed inside the laminated pole 200 while receiving a tensile force, so the erectness of the laminated pole can be efficiently maintained.

In addition, a lighting device according to another embodiment as an object installed on the longitudinal upper side of the laminated pole 200 may be comprised of an indirect lighting part 620 having a predetermined length mounted to the upper portion of the upper tension unit 400 at a longitudinal first side of the indirect lighting part, and a main lighting part 621 mounted to a longitudinal second side of the indirect lighting part 620.

Accordingly, when the lighting device having a predetermined length is mounted to the upper portion of the laminated pole 200, due to a wind load applied to the lighting device, a high load is applied to the fixed portion of the longitudinal lower side of the laminated pole 200. When this phenomenon continues, the erectness of the laminated pole 200 may not be effectively achieved. Accordingly, in the present disclosure, due to the tension tendon 500 installed inside the laminated pole 200 while receiving a tensile force, even if a heavy object having a predetermined length is installed on the upper side of the laminated pole 200, the erectness of the laminated pole 200 against a wind load can be efficiently achieved.

Here, the object 600 is described to constitute a lighting device, but is not limited thereto, and may be a structure having a predetermined weight such as a sculpture, a speaker, a photovoltaic device, or a sign. Additionally, objects on the upper ends of the pair of laminated poles may be connected to each other.

Meanwhile, as illustrated in FIG. 16, at least two wooden poles may be continuously installed in such a manner that another wooden pole is coupled to the upper side of a wooden pole mounted erectly to a mounting surface.

As described above, although the specific embodiments of the present disclosure have been described in detail, those skilled in the art may make various modifications thereof without departing from the scope of the present disclosure. Therefore, the scope of the present disclosure is not limited to the above-described embodiments, and should be defined by not only the claims described below, but also equivalents to the claims.

What is claimed is:

1. A multi-functional wooden pole having improved erectness due to a tendon, the multi-functional wooden pole comprising:

a base connection unit mounted to a mounting surface;

a wooden laminated pole mounted erectly to an upper portion of the base connection unit and having an insert hole formed inside the wooden laminated pole along a longitudinal direction thereof, an upper tension unit installed to be seated and fixed on a longitudinal upper side of the wooden laminated pole;

a tension tendon located inside the insert hole of the wooden laminated pole and having longitudinal opposite sides connected to the base connection unit and the upper tension unit, respectively, such that the tension tendon is fixedly mounted thereto while receiving a tensile force; and an object installed on the longitudinal upper side of the wooden laminated pole, wherein the base connection unit is composed of a flat base plate installed to be seated on the mounting surface so as to support the wooden laminated pole, and a lower tension part inserted into the insert hole of the wooden laminated pole from an upper surface of the flat base plate so as to tension and fix a longitudinal lower end of the tension tendon, wherein the lower tension part is composed of a hollow header mounted fixedly to the flat base plate and inserted into the insert hole, the hollow header being configured to have an inner diameter decreasing gradually toward a longitudinal second side thereof from a longitudinal first side thereof, and a tension body installed at an inside of the hollow header and configured to tension and fix the tension tendon passing through the inside of the hollow header while pressing an outer circumferential surface of a first side of the tension tendon, the upper tension unit is composed of a flat mounting plate installed to be seated on the longitudinal upper side of the wooden laminated pole, and a tension connector inserted into the insert hole of the wooden laminated pole from a lower surface of the flat mounting plate and configured to tension and fix a second side of the tension tendon, and the object is installed to be connected to an upper surface of the flat mounting plate of the upper tension unit.

2. The multi-functional wooden pole of claim 1, wherein the tension connector is mounted rotatably to the flat mounting plate such that a longitudinal side of the tension connector is held by a side surface of the flat mounting plate.

3. The multi-functional wooden pole of claim 2, wherein a holding through hole is formed in the flat mounting plate such that the tension connector passes through the holding through hole, and a slope holding end is formed on an edge of the holding through hole such that the slope holding end is inclined downward in an inward direction, and the tension connector is composed of a hollow insert header having a rotation seating end formed at a longitudinal side thereof such that the rotation seating end is held by the slope holding end, and a tendon fixer installed to be inserted into the hollow insert header and configured to tension and fix the tension tendon while pressing an outer circumferential surface of the tension tendon.

4. The multi-functional wooden pole of claim 3, wherein the tension tendon is configured to have a twisted structure in which multiple strands are spirally twisted to each other relative to an axial line.

* * * * *